US009702077B2

(12) United States Patent
Doh

(10) Patent No.: US 9,702,077 B2
(45) Date of Patent: Jul. 11, 2017

(54) WASHING MACHINE

(75) Inventor: Young Jin Doh, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1155 days.

(21) Appl. No.: 13/129,677

(22) PCT Filed: Nov. 17, 2009

(86) PCT No.: PCT/KR2009/006750

§ 371 (c)(1),
(2), (4) Date: Aug. 8, 2011

(87) PCT Pub. No.: WO2010/056086

PCT Pub. Date: May 20, 2010

(65) Prior Publication Data

US 2011/0277515 A1 Nov. 17, 2011

(30) Foreign Application Priority Data

Nov. 17, 2008 (KR) ..... 10-2008-0114172
Nov. 17, 2008 (KR) ..... 10-2008-0114173
Nov. 17, 2008 (KR) ..... 10-2008-0114180

(51) Int. Cl.
*D06F 39/02* (2006.01)
*D06F 39/08* (2006.01)

(52) U.S. Cl.
CPC ..... *D06F 39/02* (2013.01); *D06F 39/022* (2013.01); *D06F 39/08* (2013.01)

(58) Field of Classification Search
CPC ..... D06F 39/02; D06F 39/022; D06F 3/089
USPC ..... 68/3 R, 13 R, 17 R
See application file for complete search history.

(56) References Cited

U.S. PATENT DOCUMENTS

2005/0229652 A1 10/2005 Kim et al. ..... 68/237
2005/0235704 A1* 10/2005 Cho et al. ..... 68/112
2005/0274157 A1* 12/2005 Yang ..... 68/17 R
2006/0236468 A1* 10/2006 Choi et al. ..... 8/158
2007/0056330 A1* 3/2007 Song ..... 68/17 R
2007/0125134 A1* 6/2007 Park ..... 68/17 R
(Continued)

FOREIGN PATENT DOCUMENTS

CN 1516764 A 7/2004
CN 1536154 A 10/2004
(Continued)

OTHER PUBLICATIONS

Korean Decision to Grant a Patent dated Feb. 22, 2011 issued in Application No. 10-2008-0114172.
(Continued)

*Primary Examiner* — Michael Barr
*Assistant Examiner* — Benjamin L Osterhout
(74) *Attorney, Agent, or Firm* — KED & Associates, LLP

(57) ABSTRACT

The present invention relates to a washing machine which comprises: an auxiliary receiving platform which is provided on a water-supply flow pathway for the supply of washing water, and which constitutes a container structure able to support a solid additive when such an additive is introduced; and an additive storage unit which is fastened to the underside of the auxiliary receiving platform, and which stores washing water in which the solid additive has been dissolved. Further, the washing machine can use solid additives such as sheet-shaped softeners.

13 Claims, 11 Drawing Sheets

(56) References Cited

U.S. PATENT DOCUMENTS

| | | | | |
|---|---|---|---|---|
| 2007/0131000 | A1* | 6/2007 | Jeong | 68/17 R |
| 2008/0041120 | A1* | 2/2008 | Wong et al. | 68/5 R |
| 2008/0072630 | A1* | 3/2008 | Je et al. | 68/17 R |
| 2008/0072631 | A1* | 3/2008 | Je et al. | 68/17 R |
| 2008/0072632 | A1* | 3/2008 | Je et al. | 68/17 R |

FOREIGN PATENT DOCUMENTS

| | | | |
|---|---|---|---|
| CN | 1779045 | A | 5/2006 |
| DE | 37 15 832 | A1 | 11/1988 |
| EP | 1 764 437 | A1 | 3/2007 |
| JP | 11-290580 | | 10/1999 |
| JP | 2001-334098 | A | 12/2001 |
| JP | 2002-102590 | | 4/2002 |
| JP | 2002-346288 | | 12/2002 |
| KR | 10-2005-0100553 | | 10/2005 |

OTHER PUBLICATIONS

Korean Decision to Grant a Patent dated Feb. 22, 2011 issued in Application No. 10-2008-0114173.
European Search Report dated Oct. 18, 2013 issued in Application No. 09 82 6318.
Chinese Office Action dated Aug. 28, 2012 issued in Application No. 200980154628.4 (with English translation).
International Search Report issued in PCT Application. No. PCT/KR2009/006750 dated dated Jul. 14, 2010.

* cited by examiner

WASHING MACHINE

CROSS-REFERENCE TO RELATED PATENT APPLICATIONS

This application is a U.S. National State Application under 35 U.S.C. §371 of PCT Application No. PCT/KR2009/006750, filed Nov. 17, 2009, which claims priority to Korean Patent Application Nos. 10-2008-0114180, 10-2008-011473, and 10-2008-0114172, all filed Nov. 17, 2008.

BACKGROUND OF THE INVENTION

Field of the Invention

The present invention relates to a washing machine equipped with a detergent box having a structure which is used in order to introduce both liquid and sheet type fabric softeners. More specifically, the present invention relates to a washing machine which allows a user not only to supply liquid fabric softener mainly used conventionally but also to supply detergents regardless of the type of fabric softener by realizing a housing structure and water supply algorithm that enable sheet-shaped fabric softener to be dissolved sufficiently in water and supplied without additionally installing a receiving platform for sheet-shaped fabric softener when the user attempts to use a recently-developed sheet-shaped fabric softener.

Description of the Related Art

A washing machine is a device which supplies various types of detergents, such as laundry detergent, bleach, or fabric softener, and water and cleans laundry via washing, rinsing, and dewatering to remove dirt from the laundry such as clothes or bedding by using water, detergent and mechanical rotation. The laundry is washed as a washing tub containing the water, detergent, and laundry is rotated by a driving mechanism inside the washing machine.

Inside the washing machine, disposed are a water supply mechanism supplying water to a washing tub, a drainage mechanism draining water inside the washing tub to the outside, and a detergent supply mechanism on a water-supply flow pathway of the water supply mechanism supplying detergents to the inside of the washing tub.

The detergent supply mechanism includes a dispenser connected to the water-supply flow pathway and a detergent box (drawer) for containing various types of detergents including fabric softener, the detergent box being disposed in such a way that the detergent box can be loaded or unloaded to and from the dispenser.

In recent years, research has been done actively on constituents and forms of detergents. For example, in the case of fabric softener, sheet-shaped fabric softener has been put into practical use, which allows the user to pull out like tissues, in comparison to the conventional liquid type.

With such various types of detergent supply structures, the present invention provides an improved technology which gives more convenience to a manual detergent supply mechanism allowing the user to withdraw a detergent box and directly introduce various types of detergents therein.

SUMMARY OF THE INVENTION

Technical Problem

Accordingly, the present invention has been made in an effort to solve the aforementioned problems, and it is an object of the present invention to provide a washing machine which allows a user not only to supply liquid fabric softener mainly used conventionally but also to supply detergents regardless of the type of fabric softener by realizing a housing structure and water supply algorithm that enable sheet-shaped fabric softener to be dissolved sufficiently in water and supplied without additionally installing a receiving platform for sheet-shaped fabric softener when the user attempts to use a recently-developed sheet-shaped fabric softener.

It is another object of the present invention to provide a laundry treatment apparatus including an additive flow portion that causes a liquid additive to smoothly flow downward.

It is still another object of the present invention to provide a laundry treatment apparatus which can use solid additives.

Technical Solution

The present invention provides a washing machine including: an auxiliary receiving platform which is provided on a water-supply flow pathway for the supply of washing water, and which constitutes a container structure able to support a solid additive when such an additive is introduced; and an additive storage unit which is fastened to the underside of the auxiliary receiving platform, and which stores washing water in which the solid additive has been dissolved.

According to the washing machine of the present invention, the user is able to choose and introduce a desired detergent, without being constrained by the type of fabric softener including liquid and sheet types, merely by installing an auxiliary receiving platform on a conventional detergent box, in such a manner that the auxiliary receiving platform having an opening and a mesh-type support in the bottom is installed in one compartment of a detergent box at a position lower than the height of a siphon tube inside the detergent box, when a liquid fabric softener is supplied, the liquid fabric softener is held in a detergent-holding unit within the detergent box via the opening of the auxiliary receiving platform, and when a sheet-shaped fabric softener, which has been recently put into practical use, is supplied, the sheet-shaped fabric softener is immersed in firstly supplied water, with the sheet-shaped fabric softener support on the mesh-type support plate, dissolved sufficiently until the second water supply is performed, and then supplied through the siphon tube.

Moreover, the washing machine of the invention may include an auxiliary receiving platform having an additive flow portion to cause a liquid additive to flow downward. Accordingly, if the user spills the liquid additive on the auxiliary receiving platform, the additive can effectively flow to an additive storage unit through the additive flow portion. Further, washing water in which the liquid additive and a solid additive have been dissolved can easily flow to the additive storage unit through the additive flow portion.

In addition, the washing machine of the invention may include an additive seat portion for placing a solid additive thereon. Accordingly, the user can use the solid additive with ease by placing the solid additive.

DETAILED DESCRIPTION OF THE INVENTION

In what follows, a washing machine according to preferred embodiments of the present invention will be described in detail with reference to the appended drawings.

Figure 1:
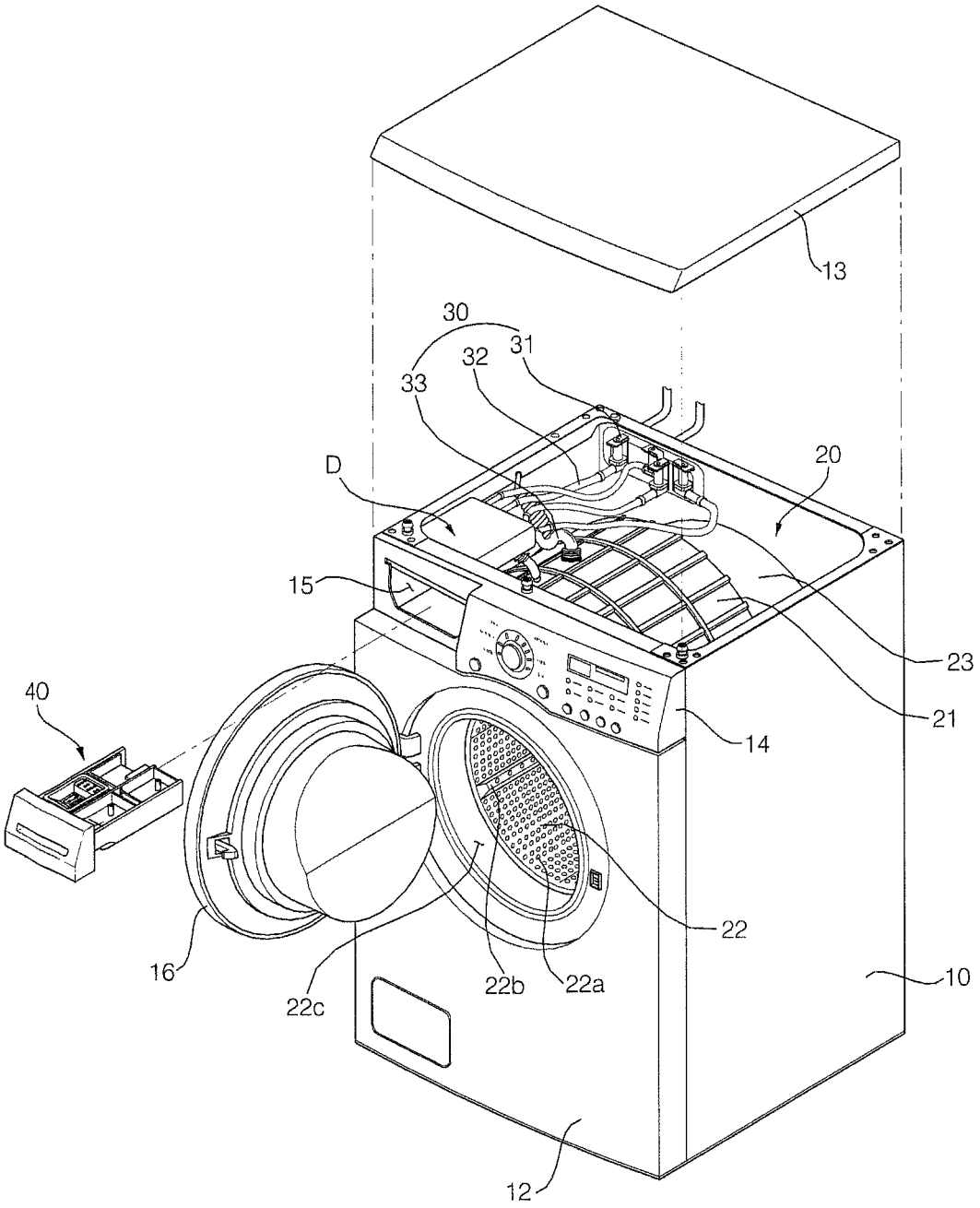
FIG. 1 is an exploded perspective view illustrating a structure of a detergent supply mechanism of a drum-type washing machine according to one embodiment of the present invention by opening a top plate.
Figure 2:
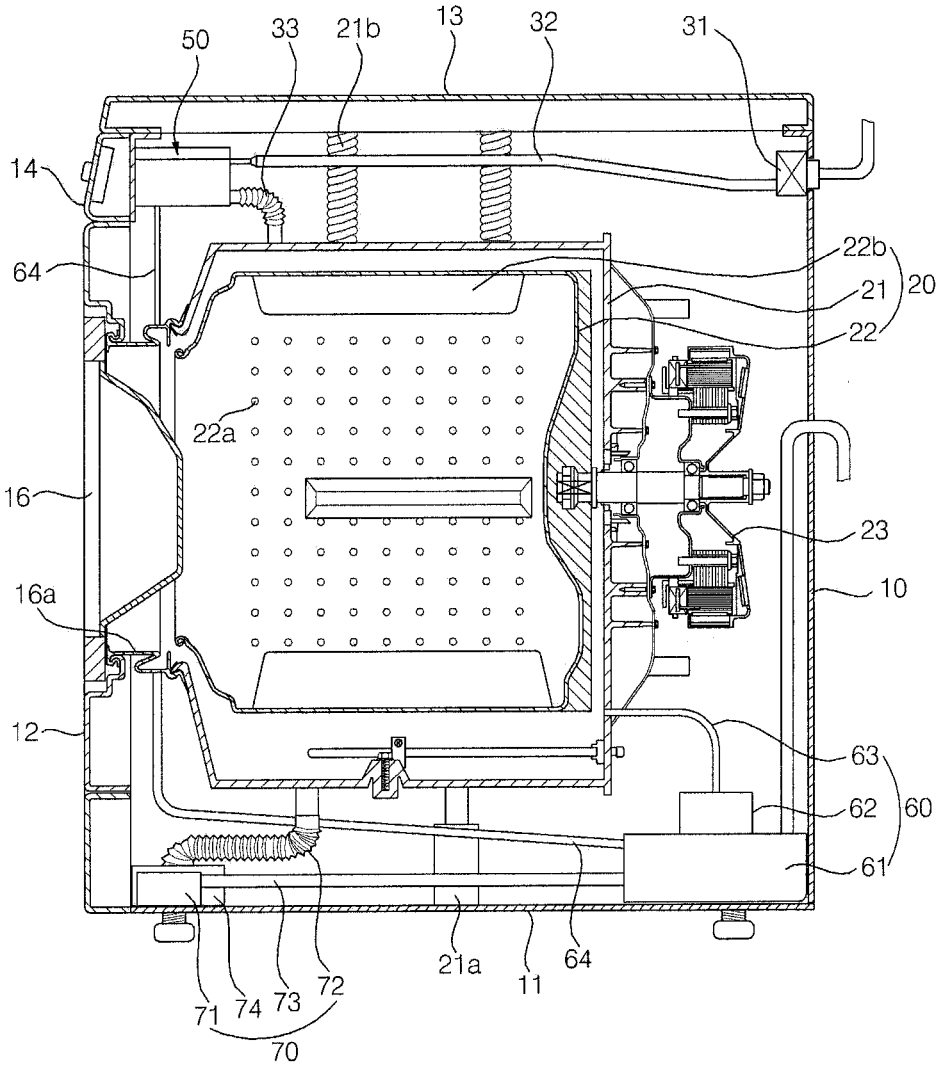
FIG. 2 is a longitudinal side sectional view illustrating the internal structure of the washing machine of FIG. 1.
Figure 3:
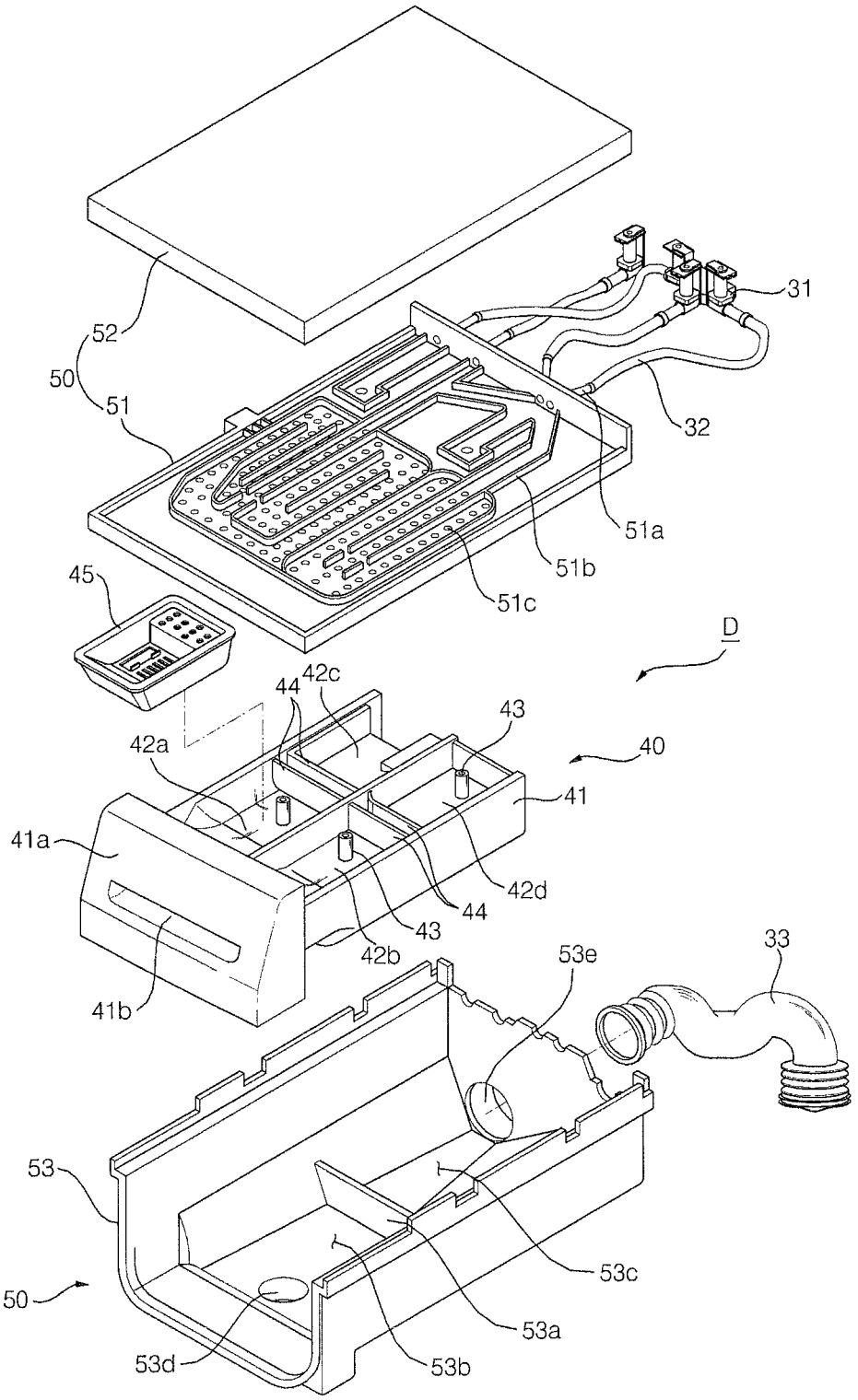
FIG. 3 is an exploded perspective view illustrating a detailed structure of a detergent supply mechanism applied to the washing machine of FIG. 1.
Figure 4:
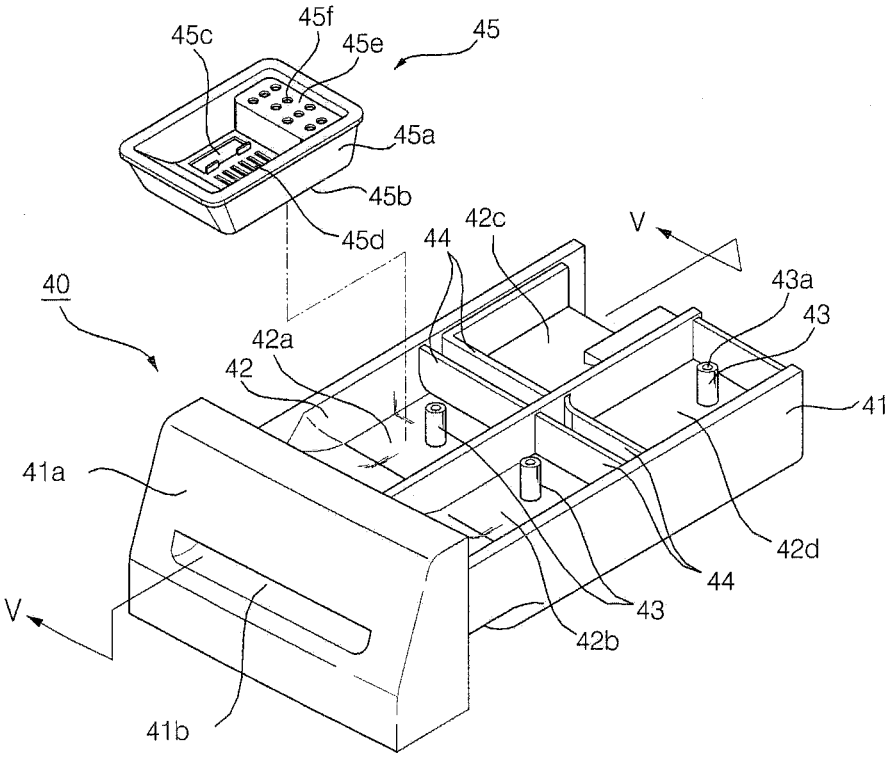
FIG. 4 is a perspective view of a structure of a detergent box applied to the washing machine of the present invention.
Figure 5:
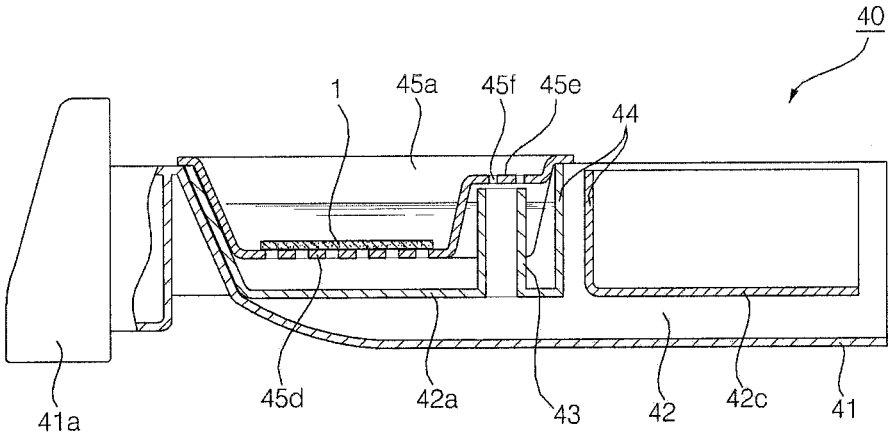
FIG. 5 is a schematic cross-sectional view of FIG. 4 along V-V line illustrating the process where a sheet-shaped fabric softener is contained in an auxiliary receiving platform applied to the detergent box of the present invention, an appropriate amount of water is introduced therein, and the fabric softener is dissolved in the water.
Figure 6:
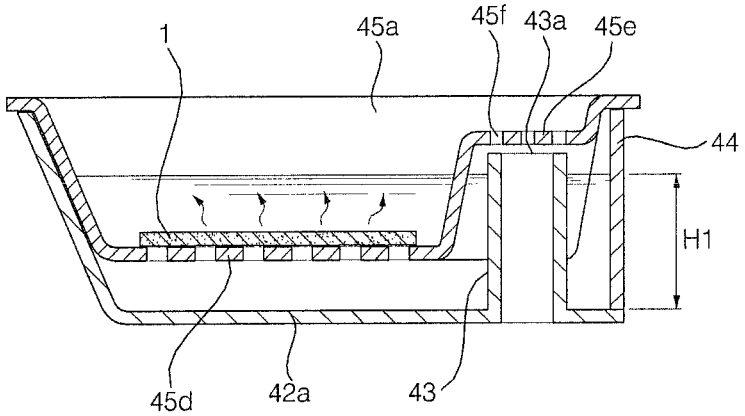
FIG. 6 is a magnified cross-sectional view illustrating a state of a partial area when the sheet-shaped fabric softener is introduced into the auxiliary receiving platform applied to the detergent box of the present invention, and water is firstly supplied within a predetermined allowable range of a water level and maintained at a set water level.
Figure 7:
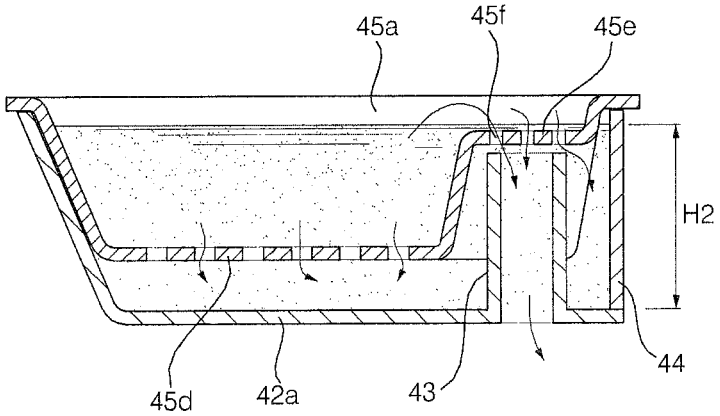
FIG. 7 is a partial magnified cross-sectional view illustrating the process where the fabric softener liquid completely dissolved within the auxiliary receiving platform applied to the detergent box of the present invention is mixed with secondly supplied water, overflows, and is supplied along a siphon tube.
Figure 8:
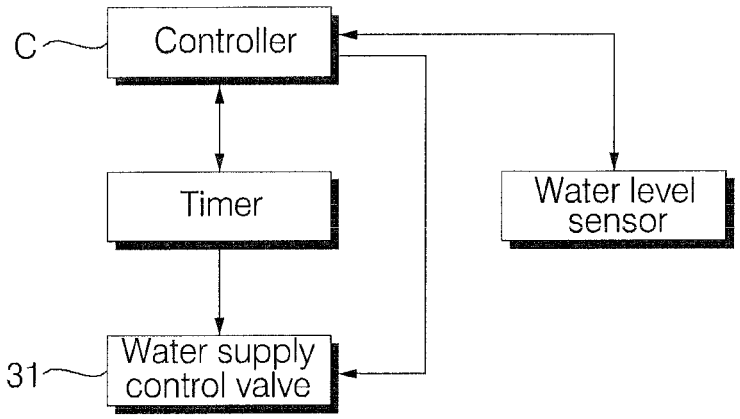
FIG. 8 is a block diagram schematically illustrating the construction of an apparatus for implementing a fabric softener water supply control method applied to the washing machine of the present invention.
Figure 9:
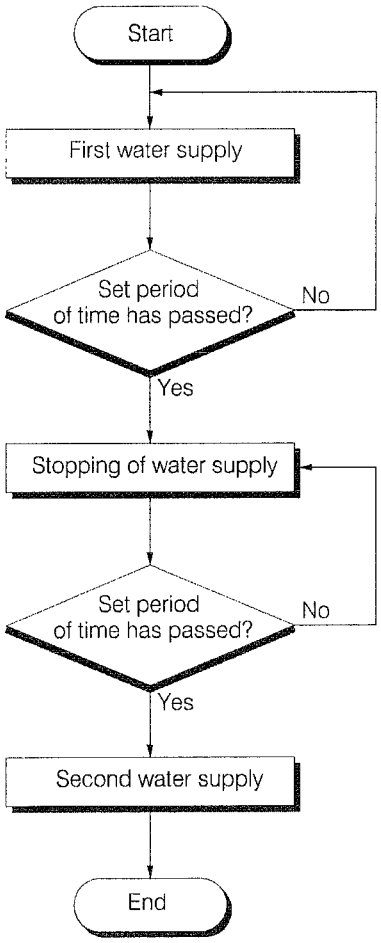
FIG. 9 is a flowchart illustrating one embodiment of a sequential process for dissolving and supplying the sheet-shaped fabric softener to be introduced into the washing machine of the present invention.
Figure 10:
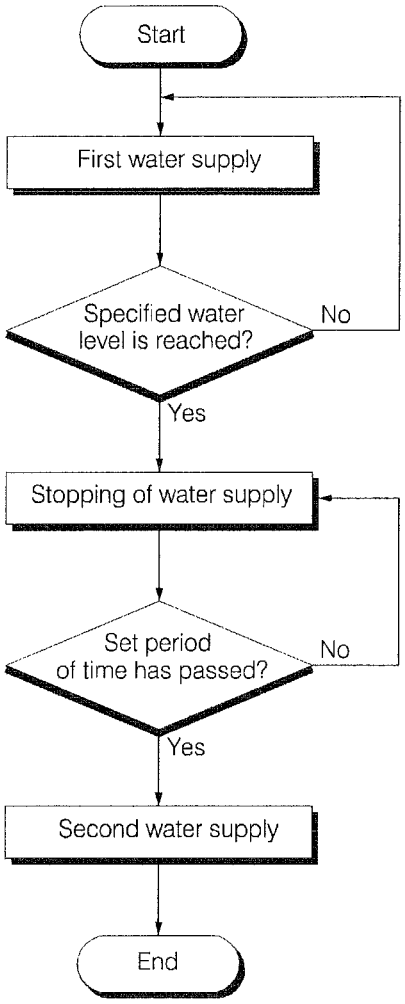
FIG. 10 is a flowchart illustrating another embodiment of a sequential process for dissolving and supplying the sheet-shaped fabric softener to be introduced into the washing machine of the present invention.

FIGS. 1 to 10 illustrate the overall structure of a washing machine according to the present invention and the structure of a detergent box 40 applied thereto. FIG. 1 is an exploded perspective view illustrating a structure of a detergent supply mechanism D of a washing machine according to one embodiment of the present invention by opening a top plate 13; FIG. 2 is a longitudinal side sectional view illustrating the internal structure of the washing machine of FIG. 1; FIG. 3 is an exploded perspective view illustrating a detailed structure of a detergent supply mechanism D applied to the washing machine of FIG. 1; FIG. 4 is a perspective view of a structure of a detergent box 40 applied to the washing machine of the present invention; FIG. 5 is a schematic cross-sectional view of FIG. 4 along V-V line illustrating the process where a sheet-shaped fabric softener 1 is contained in an auxiliary receiving platform 45 applied to the detergent box 40 of the present invention, an appropriate amount of water is introduced therein, and the fabric softener is dissolved in the water; FIG. 6 is a magnified cross-sectional view illustrating a state of a partial area when the sheet-shaped fabric softener 1 is introduced into the auxiliary receiving platform 45 applied to the detergent box 40 of the present invention, and water is firstly supplied within a predetermined allowable range H1 of a water level and maintained at a set water level; FIG. 7 is a partial magnified cross-sectional view illustrating the process where the fabric softener liquid completely dissolved within the auxiliary receiving platform 45 applied to the detergent box 40 of the present invention is mixed with secondly supplied water, overflows, and is supplied along a siphon tube 43; FIG. 8 is a block diagram schematically illustrating the construction of an apparatus for implementing a fabric softener water supply control method applied to the washing machine of the present invention; FIG. 9 is a flowchart illustrating one embodiment of a sequential process for dissolving and supplying the sheet-shaped fabric softener 1 to be introduced into the washing machine of the present invention; FIG. 10 is a flowchart illustrating another embodiment of a sequential process for dissolving and supplying the sheet-shaped fabric softener 1 to be introduced into the washing machine of the present invention First, with reference to FIGS. 1 and 2, the overall structure of a (drum-type) washing machine according to one embodiment of the present invention will be described.

A washing machine according to the present invention includes a cabinet 10 forming an external appearance; a washing tub 20 being disposed in a rotatable manner inside the cabinet 19 and receiving laundry, detergents, and water; a driving mechanism 23 being connected to the washing tub 20 and driving the washing tub 20; a water supply mechanism 30 supplying water to the washing tub 20; a detergent supply mechanism D receiving water supplied from the water supply mechanism 30 and detergents introduced by the user, mixing them, and providing the mixture to the washing tub 20; and a drainage mechanism 70 draining water contaminated after washing to the outside from the washing tub 20.

A base plate 11 is disposed in a lower part of the cabinet 10; a top plate 13 in an upper part thereof; and a front cover 12 having a control panel 14 for operation of the washing machine on the front surface thereof, altogether forming an external appearance in the shape of a conventional square box.

In the central part of the front cover 12, a laundry entrance hole 22*c* for loading or unloading laundry to and from the washing tub 20 is formed; and an opening and closing door 16 is installed thereto. Along the periphery of the laundry entrance hole 22*c*, a gasket 16*a* is installed for sealing when the door 16 is closed.

Conventionally, in one upper side of the front cover 12, formed is detergent box receiving space 15 for loading and unloading the detergent box 40 to and from the washing machine.

The washing tub 20 includes a tub 21 supported by a damper 21*a* and springs 21*b* in such a way to be installed in a shock-absorbing state inside the cabinet 10 and receiving laundry therein, a drum 22 concentrically superimposed on the tub 21 so as to be rotatable within the tub 21 to contain water and detergents therein, and having a plurality of water holes 22*a* through which the water and detergents inside the tub 21 pass; and a lifter 22*b* being disposed in the inner surface of the drum 22 and lifting up the laundry up to a predetermined height when the drum 22 is rotated and dropping down the laundry.

The water supply mechanism 30 includes a plurality of water supply control valves 31 disposed in the cabinet 10 and connected to an external water source; and a water-supply flow pathway formed between the water supply control valves 31 and the tub 21 to guide water into the tub 21. The water-supply flow pathway includes a plurality of incoming water supply pipes 32 connecting the water supply control valves 31 and the detergent supply mechanism D to each other; and an outgoing water supply pipe 33 connecting the detergent supply D and the tub 21.

Conventionally, the water supply control valve 31 is installed in such a way to penetrate an upper part of a rear surface of the cabinet 10, the water supply control valves 31 including a plurality of hot water supply control valves to let in hot water and a plurality of cold water supply control valves to let in cold water.

In particular, in the present invention, the water supply control valves 31 are mounted on the water-supply flow pathway, and are opened until the level of water supplied through the water-supply flow pathway reaches a first water level within a range higher than the inner bottom surface of the auxiliary receiving platform 45 and lower than an upper opening end 43*a* of the siphon tube 43, closed for a predetermined period of time during which the sheet-shaped fabric softener 1 can be sufficiently dissolved in the supplied water, and then re-opened to supply the dissolved fabric softener into the washing machine drum 22 through the siphon tube 43 (see FIGS. 6 and 7). The stepwise operation of the water supply control valves 31 is performed by a controller C (see FIG. 8) of the present invention, and a description of this operation will be made again below.

Between the incoming water supply pipes 32 and the outgoing water supply pipe 33, the detergent supply mechanism D is connected so that detergents can be supplied to the tub 21 together with water supplied through the water supply mechanism 30. In other words, the incoming water supply pipes 32 is installed between the water supply control valves 31 and the detergent supply mechanism D to guide water to the detergent supply mechanism D; a plurality of hot water pipes are disposed between the respective hot water supply control valves and the detergent supply mechanism D while a plurality of cold water pipes are disposed between the respective cold water supply control valves and the detergent supply mechanism D.

The drainage mechanism 70 includes a draining pump 71 providing draining power; a draining guide pipe 72 being connected to a lower part of the tub 21 and collecting and guiding washing water used for washing and rinsing by using the power of the draining pump 71; a draining pipe 73 draining the washing water to the outside; and a draining filter 74 being installed on the draining pipe 73 and filtering residue from washing.

As shown in FIG. 2, the washing machine according to the present invention may further include a separate liquid detergent supply mechanism 60 as means for getting rid of the inconvenience of putting detergent into the detergent box 40 for each washing cycle. That is, the liquid detergent supply mechanism 60 is adapted in such a way that a large amount of detergent is introduced into the detergent box 40 to store a sufficient amount of detergent in a liquid state in a separate liquid detergent storage unit 61 and a fixed amount of detergent is automatically supplied from the liquid detergent storage unit 61 at each laundry cycle. The liquid detergent supply mechanism 60 includes the liquid detergent storage unit 61 for storing at least one liquid detergent supplied to the tub 21 and a liquid detergent supply mechanism 60 for automatically supplying the liquid detergent stored in the liquid detergent storage unit 61 into the tub 21.

The liquid detergent supply mechanism 60 includes a liquid detergent supply pump 62 providing power to supply a liquid detergent into the tub 21, a liquid detergent supply pipe 63 connecting between the liquid detergent storage unit 61 and the tub 21, and a liquid detergent supply connection pipe 64 connecting between the detergent box 40 and the liquid detergent storage unit 61.

Of course, the liquid detergent supply mechanism 60 may have other various configurations. In one example, the liquid detergent supply pipe 63 may be directly connected to the water supply mechanism 30.

By further including the liquid detergent supply mechanism 60 including a separate liquid detergent storage unit 61 as above, the liquid detergent storage unit 61 is connected to the detergent box 40 by the liquid detergent supply connection pipe 64 to allow a liquid detergent to be additionally stored inside the liquid detergent storage unit 61.

Further, in the present invention, a plurality of liquid detergent storage units 61 may be provided depending on the type of liquid detergent used for washing, and a plurality of liquid detergent supply ports 53*d* for introducing liquid detergent in the liquid detergent storage units 61 may be formed in the detergent box 40.

As shown in FIGS. 1 to 4, the detergent supply mechanism D includes a dispenser 50 to which the incoming water supply pipes 32 and the outgoing water supply pipe 33 are connected and a detergent box 40 disposed inside the dispenser 50 to be drawn in and out forward and backward and having a detergent-holding unit 42 partitioned into a plurality of compartments 42*a*, 42*b*, 42*c*, and 42*d* for separately holding at least one detergent.

As shown in FIG. 3. The dispenser 50 includes a dispenser housing 53, which is installed in the detergent box receiving space 15 of the cabinet 10 (see FIG. 1) and whose front and top are open, a cover for covering the open top of the dispenser housing 53, and a dispenser body 51 mounted in the dispenser housing 53 and the cover 52 and spraying water coming from the incoming water supply pipes 32 to the detergent-holding unit 42 of the detergent box 40.

The dispenser housing 53 has a plurality of space portions 53*b* and 53*c* divided into front and rear areas by a partition 53*a* crossing the interior thereof. A liquid detergent supply opening 53*d* communicating with the liquid detergent supply connection pipe 64 penetrates the front space portion 53*b*, and a liquid detergent discharge opening 53*e* communicating with the outgoing water supply pipe 33 penetrates the rear space portion 53*c*.

The dispenser body 51 is enclosed with the cover 52 to form a branch flow path 51*b*, is provided on the rear surface with a plurality of pipe connecting portions 51*a* connected to ends of the incoming water supply pipes 32, and has a plurality of nozzles 51*c* formed at the corresponding positions so as to spray water to the respective compartments 42*a*, 42*b*, 42*c*, and 42*d* of the detergent box 40.

As shown in FIGS. 3 to 5, the detergent box 40 is received within the dispenser housing 53 and disposed below the dispenser body 51. The detergent box 40 includes a detergent box body 41 forming the detergent-holding unit 42 partitioned off into compartments 42*a*, 42*b*, 42*c*, and 42*d* for separately containing detergent and fabric softener, a front cover 41*a* formed on the front surface of the detergent box body 41, and an auxiliary receiving platform 45 for receiving both of the sheet-shaped fabric softener 1 and the liquid fabric softener. The front cover 41*a* has a hand grip 41*b* that allows the user to withdraw the detergent box body 41 and put detergent therein. At least one of the compartments 42*a*, 42*b*, 42*c*, and 42*d* is provided with an additive storage unit for storing an additive such as fabric softener.

The detergent-holding unit 42 may have a structure for holding both liquid detergent and powdered detergent. For example, as shown in FIG. 4, the detergent-holding unit 42 may be partitioned off into four compartments 42*a*, 42*b*, 42*c*, and 42*d* by a partition 44 to separately hold a liquid detergent in one compartment 42*a*, a powdered detergent in another compartment 42*b*, a bleach in still another compartment 42*c*, and a fabric softener in the remaining compartment 42*d*. Usually, an auxiliary receiving platform 45 is installed at each of the compartments 42*a*, 42*b*, 42*c*, and 42*d* according to the properties of detergents to be held therein.

Alternatively, the first and second compartments 42*a* and 42*b* may be adapted to hold the powdered detergent used for main washing and rough washing, and the third and fourth compartments 42*c* and 42*d* be adapted to hold the bleach and the fabric softener, respectively.

For convenience, the figures (FIGS. 3 to 7) of the present invention are illustrated on the assumption that the auxiliary receiving platform 45 is installed at the first compartment 42*a*, and the sheet-shaped fabric softener 1 or liquid fabric softener is received in the first compartment 42*a* and the auxiliary receiving platform 45. A structure based on this assumption will be described below.

As shown in FIGS. 4 and 5, a siphon tube 43 may be protruded upward from each of the compartments 42*a*, 42*b*, 42*c*, and 42*d* to dissolve the respective detergents and discharge them through the incoming water supply pipes 32 or the outgoing water supply pipe 33 when water from the water supply mechanism 30 is filled up. That is, because a liquid or sheet-shaped fabric softener is introduced into the first compartment 42*a*, the first compartment 42*a* has a siphon tube 43 for discharging the fabric softener according to the siphon principle.

The auxiliary receiving platform 45 is provided with a container-shaped receiving platform body 45*a* overlaid on one compartment 42*a* of the detergent box body 41 and supporting the sheet-shaped fabric softener 1 when the sheet-shaped fabric softener is introduced. A bottom surface (base) 45*b* of the receiving platform body 45*a* is formed at a position relatively lower than the upper opening end 43*a* of the siphon tube 43.

More specifically, the auxiliary receiving platform 45 includes an opening port 45*c* which is formed at the base in order to directly introduce the liquid fabric softener into the corresponding compartment 42*a* of the detergent box body 41 when the liquid fabric softener is introduced, and a support plate 45*d* which is formed at one side of the opening port 45*c* to support the sheet-shaped fabric softener 1 when the sheet-shaped fabric softener 1 is introduced in order to ensure a sufficient amount of time for the sheet-shaped fabric softener 1 to be dissolved in the firstly supplied water. The support plate 45*d* has a mesh-type structure to enable the upward and downward flow of water.

Also, the auxiliary receiving platform 45 has an overflow surface 45*e* formed at one bottom side thereof, whose bottom is relatively shallower than the position of the support plate 45*d*. A plurality of drainage holes 45*f* are formed on the overflow surface 45*e* to introduce the fabric softener into the washing machine drum 22. The siphon tube 43 is positioned below the overflow surface 45*e*.

As shown in FIG. 8, the controller C may include a timer, and operation time for each step is entered and set into the controller C to open, close, and re-open the water supply control valves 31 at regular time intervals. For instance, the duration of dissolving of the sheet-shaped fabric softener 1 after supplying water until the first water level is reached and stopping the water supply may be set to 1 to 2 minutes.

Alternatively, a water level sensor for detecting whether water reaches the first water level may be further provided within the detergent box 40. With this water level sensor, the controller C may detect a signal transmitted from the water level sensor and control the water supply control valves 31 to be opened, closed, and re-opened in a stepwise manner.

The operation of the thus-constructed washing machine according to a preferred embodiment of the present invention will be described below with reference to FIG. 2.

First, laundry is put into the drum 22 via a laundry entrance 22, and the laundry entrance 22*c* is enclosed with the door 16 and then the washing machine is operated. At this time, the washing machine senses the volume of the laundry put in the drum 22, and sets water level, supply amount of detergent, washing time, and so on.

Then, the water supply mechanism 30 is operated to supply water into a tub 21 until a set water level is reached. In other words, when the water supply control valves 31 of the water supply mechanism 30 are opened, water is introduced from an external water source via the water supply control valves 31, and the water is supplied into the tub 21 along the incoming water supply pipes 32, the detergent supply mechanism D, and the outgoing water supply pipe 33.

At this point, if detergent, bleach, fabric softener, etc. have been put in the detergent-holding unit 42 of the detergent box 40, the detergent, bleach, fabric softener, etc. in the detergent-holding unit 42 are supplied, together with the water supplied from the water supply mechanism 30, into the tub 21. The present invention will be illustrated and described with reference to an example where fabric softener is received in the first compartment 42*a*.

On the other hand, if no detergent has been put in the detergent-holding unit 42 of the detergent box 40, the separate liquid detergent supply mechanism 60 is operated to supply a liquid detergent into the tub 21 until a set supply amount is reached. That is, when the liquid detergent supply pump 62 of the liquid detergent supply mechanism 60 is operated, the liquid detergent 1 stored in the liquid detergent storage unit 61 is pumped by the liquid detergent supply pump 62, and the liquid detergent 1 flows into the tub 22 along the liquid detergent supply pipe 63.

Once the supply of water and detergent into the tub 21 is finished, the driving mechanism (motor) 23 is operated to rotate the drum 22 for a set period of time. Thus, the laundry in the drum 22 is lifted upward and then dropped downward by the rotation of the drum 22 and the lifter 22*b*, thereby performing washing.

Once the washing stroke for the laundry is finished, the operation of the driving mechanism 23 is stopped, and then the draining mechanism 70 is operated to drain out the water used for the washing in the tub 21. Next, the water supply mechanism 30 is operated to re-supply water until a set water level is reached, and the driving mechanism 23 is operated to re-rotate the drum 22, thereby performing the rinsing of the laundry.

Once the rinsing stroke for the laundry is finished, the operation of the driving mechanism 23 is stopped, and then the draining mechanism 70 is operated to drain out the water used for the rinsing in the tub 21. Then, when the water is completely drained out of the tub 21, the driving mechanism 23 is operated again to rotate the drum 22 at a high speed, and thereafter the operation of the washing machine is stopped. Once the drum 22 is rotated at a high speed, the water contained in the laundry is discharged to the outside of the drum 22, and the water collected in the tub 21 is drained out by the drainage mechanism 70.

In the overall washing process, the step of causing water to flow in the detergent supply mechanism D during operation of the water supply mechanism 30 and the step of supplying water and detergent to the tub 21 will be described more concretely based on FIGS. 3 to 10.

When the detergent box 40 is completely inserted in the dispenser 50, as shown in FIGS. 3 to 5, water enters the dispenser body 51 through the water supply control valves 31 and the incoming water supply pipes 32, and the water is sprayed into the detergent-holding unit 42 of the detergent box 40 through the nozzles 51*c* of the dispenser body 51. Also, the water sprayed into the detergent-holding unit 42 flows rearward along the bottom surface of the detergent-holding unit 42, and thereafter discharged to the rear space portion 53*c* of the dispenser housing 53. The water stored in the rear space portion 53*c* enters the outgoing water supply pipe 33 through the liquid detergent outlet 53*e*, and supplied into the tub 21 through the outgoing water supply pipe 33.

Accordingly, if appropriate amounts of laundry detergent, bleach, and fabric softener have been put into the detergent-holding unit 42 before the water supply mechanism 30 is operated, the respective detergents are dissolved in the water sprayed into the detergent-holding unit 42, and the water and the detergent flow along the rear space portion 53*c* and the outgoing water supply pipe 33 and supplied into the tub 21.

Once the detergent box 40 has been inserted in the dispenser 50, even if the water from the water supply mechanism 30 is supplied to any one of the compartments 42*a*, 42*b*, 42*c*, and 42*d* of the detergent-holding unit 42, the respective detergents held in the detergent-holding unit 42 and the water supplied from the water supply mechanism 30 flow to the tub 21 along the rear space portion 53*c* and the outgoing water supply pipe 33.

A process for supplying fabric softener, etc. by the detergent box 40 of the present invention will now be described in detail. As shown in FIGS. 4 and 5, the auxiliary receiving platform 45 is stacked on the compartment 42*a* of the detergent box 40. The auxiliary receiving platform 45 is installed such that the overflow surface 45*e* is placed on top of the siphon tube 43.

In this state, when a liquid fabric softener is introduced, the liquid fabric softener is received in the corresponding compartment 42*a* through the opening port 45*c* of the auxiliary receiving platform 45, and when the sheet-shaped fabric softener 1 is introduced, the sheet-shaped fabric softener 1 is placed on top of the mesh type support plate 45*d*. A process for supplying fabric softener is carried out in the same way as when a typical detergent is introduced, so a detailed description thereof will be omitted.

Once the sheet-shaped fabric softener 1 is placed on top of the support plate 45*d* of the auxiliary receiving platform 45, water supply begins.

In the present invention, in order to perform the process of sufficiently dissolving the sheet-shaped fabric softener by the control of the controller C, as shown in the flowcharts (sequential diagrams) shown in FIGS. 9 and 10, first water supply, stopping of water supply, and second water supply are sequentially carried out. That is, if the controller C has a timer function, a sufficient time for dissolving the sheet-shaped fabric softener 1 can be obtained by controlling the water supply control valves 31 to be opened and closed for a predetermined water supply stop time input (see FIG. 9).

Moreover, if a separate water level sensor is attached into the detergent box, the water level sensor detects whether water reaches a first water level and transmits information (electrical signal) on the water level to the controller C. Then, a sufficient time for dissolving the sheet-shaped fabric softener 1 can be obtained by allowing the controller C to control the opening and closing of the water supply control valves 31 according to the signal information (see FIG. 10).

FIGS. 6 and 7 depict a state when the first water supply and the second water supply are performed by the use of the auxiliary receiving platform 45 of the present invention. First, the maximum allowable water level H1 for the first water supply shown in FIG. 6 is a level not exceeding the upper opening end 43*a* of the siphon tube 43, within which water maintains such a stable level as not to overflow the upper opening end 43*a* of the siphon tube 43. As such, the sheet-shaped fabric softener 1 can be kept immersed in water for a predetermined period of time, being stably supported on the support plate 45*d* of the auxiliary receiving platform 45. Hence, the sheet-shaped fabric softener 1 can be sufficiently dissolved.

After the sheet-shaped fabric softener 1 is dissolved in water, the second water supply is performed as shown in FIG. 7. At this point, the minimum water level H2 for the second water supply remains higher than the overflow surface 45*e* of the auxiliary receiving platform 45. As such, a drainage operation using the siphon tube 43 is induced, and the fabric softener enters the drum 22.

In the case that the liquid detergent supply mechanism 60 and the liquid detergent storage unit 61 are provided inside the washing machine, liquid detergent, bleach, and fabric softener may be supplied into the tub 21 from the liquid detergent supply mechanism 60 and the liquid detergent storage unit 61 as shown in FIG. 2. The step of supplying a liquid detergent from this equipment will be described below in detail.

The detergent box 40 is drawn out to put laundry detergent, bleach, and fabric softener in the detergent-holding unit 42, and then received inside the dispenser 50. The respective detergents enter the front space portion 53*b* of the dispenser housing 53, and the detergent stored in the front space portion 53*b* is discharged along the liquid detergent supply connection pipe 64 through the liquid detergent supply opening 53*d* formed in the front space portion 53*b* and stored inside the liquid detergent storage unit 61.

Accordingly, when various types of detergents are put in the detergent-holding unit 42 of the detergent box 40, rather than directly putting the liquid detergent in the liquid detergent storage unit 61, the liquid detergent mixed with water can be reserved in the liquid detergent storage unit 61. Moreover, the detergent box 40 can be used for the supply of water, the supply of liquid detergents, and the storage of the liquid detergents, thus enhancing the utilization of the part.

Figure 11:
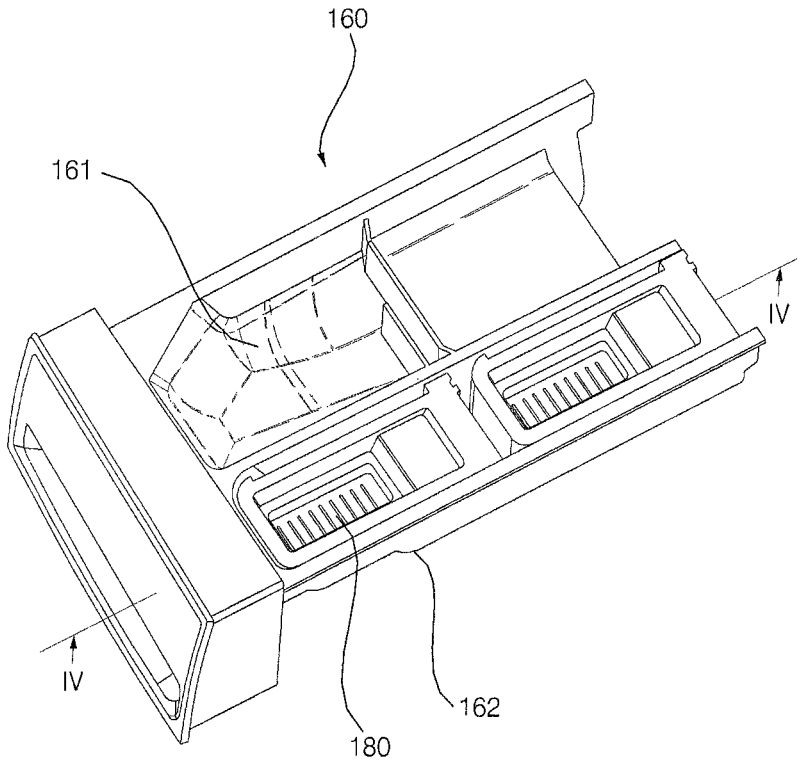
FIG. 11 is a perspective view showing one embodiment of the detergent box applied to the washing machine of the present invention.
Figure 12:
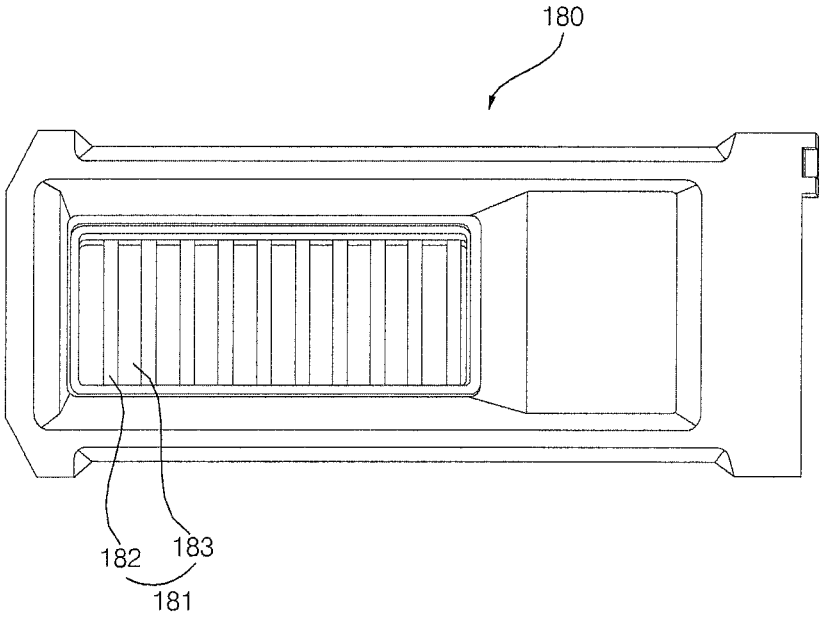
FIG. 12 is a front view illustrating the auxiliary receiving platform illustrated in FIG. 11.
Figure 13:
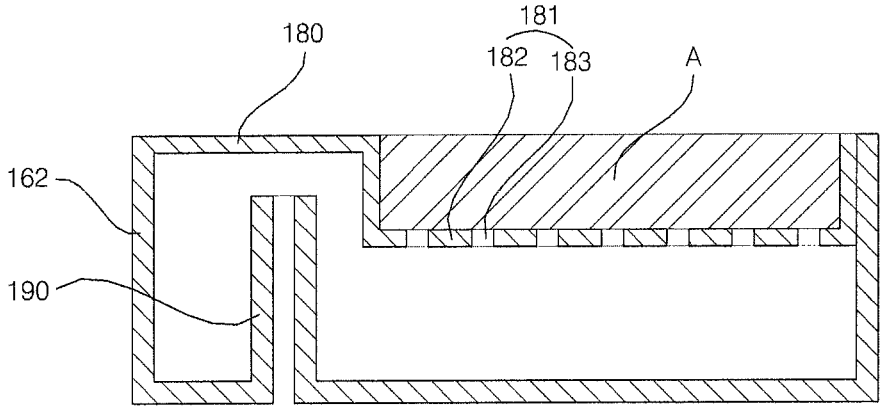
FIG. 13 is a cross-sectional view showing a cross section taken along IV-IV line of FIG. 11.

FIG. 11 is a perspective view showing one embodiment of the detergent box 160 applied to the washing machine of the present invention. FIG. 12 is a front view illustrating the auxiliary receiving platform 180 illustrated in FIG. 11. FIG. 13 is a cross-sectional view showing a cross section taken along IV-IV line of FIG. 11;

Referring to FIGS. 11 to 13, the detergent box 160 includes a detergent storage unit 161 storing detergent therein and an additive storage unit 162 formed at one side of the detergent storage unit 161 and storing an additive such as fabric softener to be mixed with washing water. The additive storage unit 162 is fastened to the auxiliary receiving platform 180 with an additive seat portion 181 for placing a solid additive thereon.

The auxiliary receiving platform 181 includes seats 182 for placing the solid additive thereon and flow holes 183 formed between the seats 182 and adapted to allow washing water to flow therethrough. The additive seat portion 181 is recessed downward so as to place the solid additive thereon.

The solid additive may be formed in a sheet-shape. If the solid additive is formed in a sheet-shape, the solid additive is placed on the additive seat portion 181. The additive seat portion 181 is formed with flow holes 183 so as to allow the solid additive-dissolved washing water to flow to the additive storage unit 162. The flow holes 183 are formed in plural form so as to be spaced apart at predetermined intervals. Further, the additive seat portion 181 includes a sloping surface sloped toward the flow holes 183. That is, the additive seat portion 181 has a slope in the direction in which the flow holes 183 are formed. If there is only one flow hole 183, the slope extends from the outer periphery toward the flow holes 183. Accordingly, the washing water flowing through the additive seat portion 181 smoothly flows to the flow holes 183 along the slope. In addition, the additive storage unit 162 has an outlet 190 adapted to allow the washing water stored in the additive storage unit 162 to flow out. The height of the outlet 190 is different from the height from the additive storage unit 162 to the additive seat portion 181. In other words, the height of the outlet 190 is greater than the height from the additive storage unit 162 to the additive seat portion 181.

The user inserts a detergent and an additive into the detergent box 160 before operating the washing machine according to one embodiment of the present invention. If the additive is a liquid additive, the additive flows to the additive storage unit 162 via the flow holes 183. The flowing liquid additive is mixed with washing water supplied from the outside. The water level of the mixed washing water rises at the additive storage unit 162. If the water level rises to the height of the outlet 190, the mixed washing water flows out through the outlet 190. Although not shown, a siphon tube is overlaid on the top of the outlet 190 to allow the mixed washing water to flow through a flow path formed between the outlet 190 and the siphon tube.

Otherwise, in the case of a solid additive, the user places the solid additive on the additive seat portion 181. Once the solid additive is placed thereon, washing water is supplied from the outside. The washing water is sprayed downwardly from the top of the additive seat portion 181. The solid additive is mixed with the sprayed washing water. The washing water mixed with the solid additive is stored in the additive storage unit 162. The stored washing water raises the water level of the additive storage unit 162 as washing water is supplied from the outside, and flows out through the outlet 190 in the same or similar manner as what has been previous described. The outflowing additive enters the tub 21 and/or drum 22. Meanwhile, the outlet 190 is formed at the additive storage unit 162 and extends from the base of additive storage unit 162. Also, the height of the outlet 190 is greater than the height from the additive storage unit 162 to the additive seat portion 181. The washing water sprayed down from the top of the additive seat portion 181 prevents the solid additive from not being dissolved. That is, some portion of the sprayed washing water is stored in the additive storage unit 162. The solid additive stored in the additive seat portion 181 is readily dissolved in the stored washing water. Accordingly, the solid additive is effectively dissolved, and therefore the washing machine provides the user with the same or similar effect as when using the liquid additive.

Figure 14:
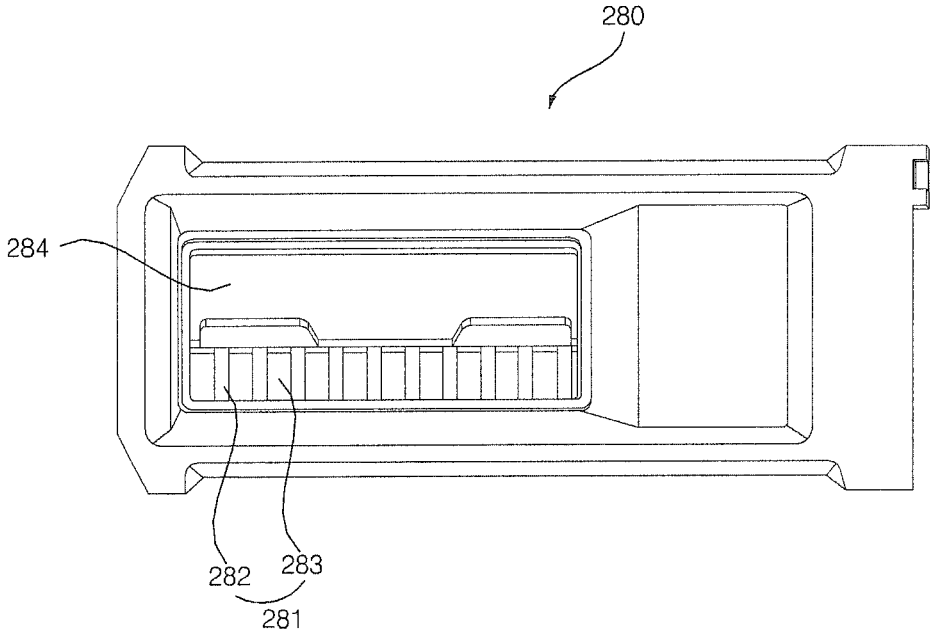
FIG. 14 is a front view illustrating another embodiment of the auxiliary receiving platform applied to the washing machine of the present invention.

FIG. 14 is a front view illustrating another embodiment of the auxiliary receiving platform applied to the washing machine of the present invention. The same reference numerals same as those used in the first embodiment indicate the same members. In the following, a description will be given focusing on the differences between the previous embodiment and this embodiment.

Referring to FIG. 14, the additive seat portion 281 includes additive seats 281 for placing the solid additive thereon and a liquid additive inlet 284 formed at one side of the additive seats 281. The additive seat portion 281 is formed in the same or similar manner as described in FIG. 4.

Now, the operation of the washing machine will be described. The user inserts the liquid additive through the liquid additive inlet 284. The liquid additive is stored in the additive storage unit 162 through the liquid additive inlet 284. When washing water enters from the outside, the washing water enters the liquid additive inlet 284. Moreover, the washing water flows to the additive storage unit 162 via the flow holes 283 formed in the additive seat portion 281. The liquid additive is mixed with the flowing washing water. The mixed washing water flows out through the outlet 190 in the same or similar manner as what has been previous described. The outflowing washing water enters the tub 21 and the drum 22.

When using a solid additive, the user places the solid additive on the additive seat portion 281. The solid additive may be formed in a sheet-shape. If the solid additive is sheet-shaped, the user folds the sheet-shaped additive to be suitable for the additive seat portion 281 and places it thereon. Once the user places the solid additive on the additive seat portion 281, washing water enters from the outside. The entering washing water dissolves the solid additive placed on the additive seat portion 281. The washing water with which the additive is dissolved is stored in the additive storage unit 162. The additive seat portion 281 is formed in the same or similar manner as what has been described in the previous embodiment. That is, the additive seat portion 281 is recessed downward so as to be at a position lower than the outlet 190. The height of the outlet 190 is greater than the height from the additive storage unit 162 to the additive seat portion 281. Accordingly, the user is able to place and use the solid additive by means of the additive seat portion 281. In addition, if the solid additive is sheet-shaped, the user can use the solid additive with ease by means of the additive seat portion 281.

Figure 15:
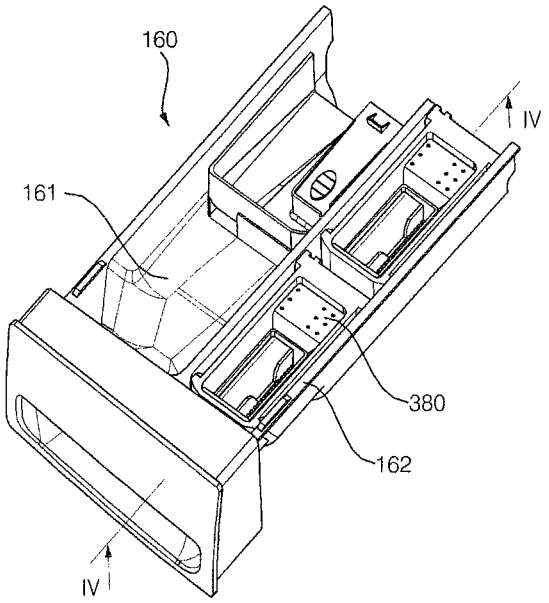
FIG. 15 is a perspective view showing a coupled state of the detergent box of FIG. 11 and the auxiliary receiving platform according to another embodiment of the present invention.
Figure 16:
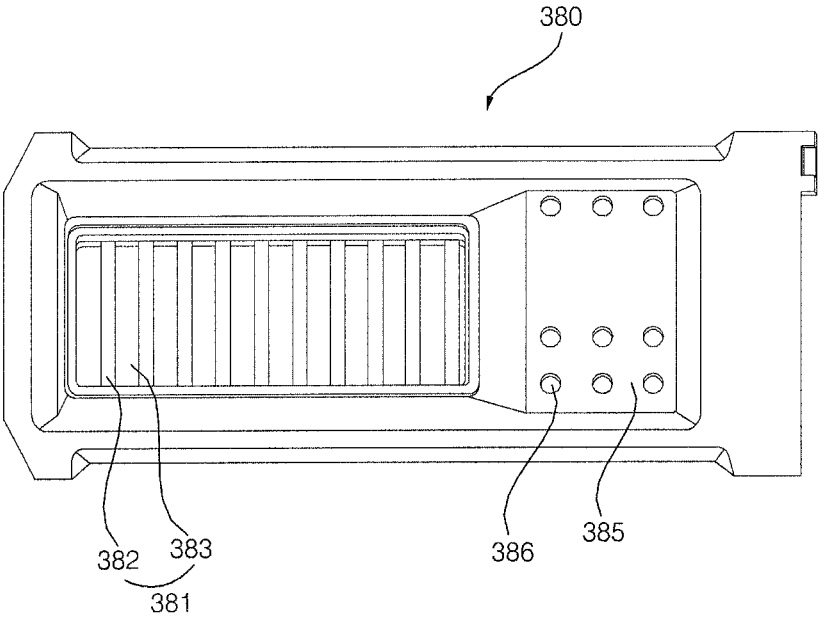
FIG. 16 is a front view illustrating the auxiliary receiving platform illustrated in FIG. 15.
Figure 17:
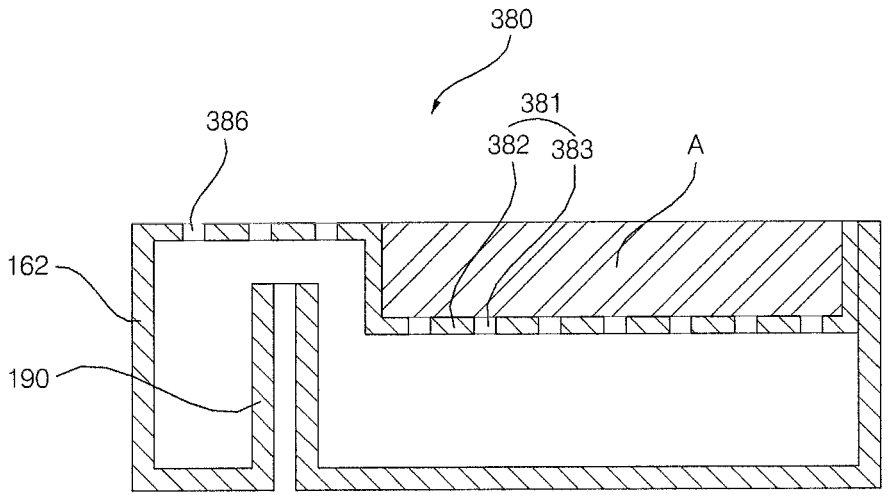
FIG. 17 is a cross-sectional view showing a cross-section taken along IV-IV line of FIG. 15.

FIG. 15 is a perspective view showing a coupled state of the detergent box 160 of FIG. 11 and the auxiliary receiving platform 380 according to another embodiment of the present invention. FIG. 16 is a front view illustrating the auxiliary receiving platform 380 illustrated in FIG. 15. FIG. 17 is a cross-sectional view showing a cross-section taken along IV-IV line of FIG. 15.

Referring to FIGS. 15 to 17, the detergent box 160 includes a detergent storage unit 161 storing detergent therein and an additive storage unit 162 formed at one side of the detergent storage unit 161 and storing an additive such as fabric softener to be mixed with washing water. The additive storage unit 162 is fastened to the auxiliary receiving platform 380 with an additive seat portion 381 for placing a solid additive thereon.

The auxiliary receiving platform 380 includes an additive seat portion 381 for placing the solid additive thereon and an additive flow portion 385 formed at one side of the additive seat portion 381 and adapted to allow a liquid additive to flow to the additive storage unit 162.

The additive flow portion 385 is formed at one side of the additive seat portion 381, and includes additive flow holes 386 adapted to allow a liquid additive to flow to the additive storage unit 162. The additive flow holes 386 are formed in plural form, and the plurality of additive flow holes 386 are spaced apart at predetermined intervals. Further, the additive flow portion 385 includes a sloping surface forming a predetermined angle with respect to one side. The sloping surface extends toward the additive flow holes 386 from one side of the additive flow portion 385. With the sloping surface being inclined toward the additive flow holes 386, the washing water and liquid additive flowing along the additive flow portion 385 flows to the additive storage unit 162.

When introducing a liquid additive, the user inserts the liquid additive into the additive storage unit 162. The inserted liquid additive is mixed with washing water sprayed by the washing water spraying device. At this point, the washing water flows to the additive flow portion 385. Also, when the user inserts the liquid additive into the additive storage unit 162, part of the liquid additive is adsorbed onto the additive flow portion 385. The liquid additive adsorbed onto the additive flow portion 385 flows to the additive flow holes 386 along the sloping surface. The flowing liquid additive flows to the additive storage unit 162 via the additive flow holes 386. Accordingly, the liquid additive does not remain adsorbed onto the additive flow portion 385, but flows to the additive storage unit 162.

Moreover, when the washing water is sprayed and mixed with the liquid additive, the washing water overflows the auxiliary receiving platform 380. The overflowing washing water flows to the additive flow portion 385. The washing water flowing to the additive flow portion 385 flows to the additive storage unit 162 via the additive flow holes 386. Accordingly, the liquid additive is not adsorbed onto the additive flow portion 385 as the liquid additive flows via the additive flow holes 386. In addition, the washing water stored in the additive storage unit 162 is prevented from flowing out over the additive storage unit 162.

The additive seat portion 381 includes seats 382 for placing the solid additive thereon and flow holes 383 formed between the seats 382 and adapted to allow washing water to flow therethrough. The additive seat portion 381 is recessed downward so as to place the solid additive thereon.

The solid additive may be formed in a sheet-shape. If the solid additive is formed in a sheet-shape, the solid additive is placed on the additive seat portion 381. The additive seat portion 381 is formed with flow holes 383 so as to allow solid additive-dissolved washing water to flow to the additive storage unit 162. The flow holes 383 are formed in plural form so as to be spaced apart at predetermined intervals. Further, the additive seat portion 381 includes a sloping surface sloped toward the flow holes 383. That is, the additive seat portion 381 has a slope in the direction in which the flow holes 383 are formed. If there is only one flow hole 383, the slope extends from the outer periphery toward the flow holes 383. Accordingly, the washing water flowing through the additive seat portion 381 smoothly flows to the flow holes 383 along the slope. In addition, the additive storage unit 162 has an outlet 190 adapted to allow the washing water stored in the additive storage unit 162 to flow out. The height of the outlet 190 is different from the height from the additive storage unit 162 to the additive seat portion 381. In other words, the height of the outlet 190 is greater than the height from the additive storage unit 162 to the additive seat portion 381.

The user inserts a detergent and an additive into the detergent box 160 before operating the washing machine according to one embodiment of the present invention. If the additive is a liquid additive, the additive flows to the additive storage unit 162 via the flow holes 383. The flowing liquid additive is mixed with washing water supplied from the outside. The water level of the mixed washing water rises at the additive storage unit 162. If the water level rises to the height of the outlet 190, the mixed washing water flows out through the outlet 190. Although not shown, a siphon tube is overlaid on the top of the outlet 190 to allow the mixed washing water to flow through a flow path formed between the outlet 190 and the siphon tube.

Otherwise, in the case of a solid additive, the user places the solid additive on the additive seat portion 381. Once the solid additive is placed thereon, washing water is supplied from the outside. The washing water is sprayed down from the top of the additive seat portion 381. The sprayed washing water causes the solid additive to be mixed with the washing water. The washing water mixed with the solid additive is stored in the additive storage unit 162. The stored washing water raises the water level of the additive storage unit 162 as washing water is supplied from the outside, and flows out through the outlet 190 in the same or similar manner as what has been previous described. The outflowing additive enters the tub 21 and/or drum 22.

Meanwhile, the outlet 190 is formed at the additive storage unit 162 and extends from the base of additive storage unit 162. Also, the height of the outlet 190 is greater than the height from the additive storage unit 162 to the additive seat portion 381. The washing water sprayed down from the top of the additive seat portion 381 prevents the solid additive from not being dissolved. That is, some portion of the sprayed washing water is stored in the additive storage unit 162. The solid additive stored in the additive seat portion 381 is readily dissolved in the stored washing water. Accordingly, the solid additive is effectively dissolved, and therefore the washing machine provides the user with the same or similar effect as when using the liquid additive.

In the case of a solid additive, the solid additive is placed on the additive seat portion 381. Once the solid additive is placed on the additive seat portion 381, washing water is sprayed downwardly by the washing water spraying device. The solid additive is dissolved in the downwardly sprayed washing water and flows to the additive storage unit 162. If the washing water continues to enter, the washing water overflows the additive storage unit 162 and flows to the additive flow portion 385.

Figure 18:
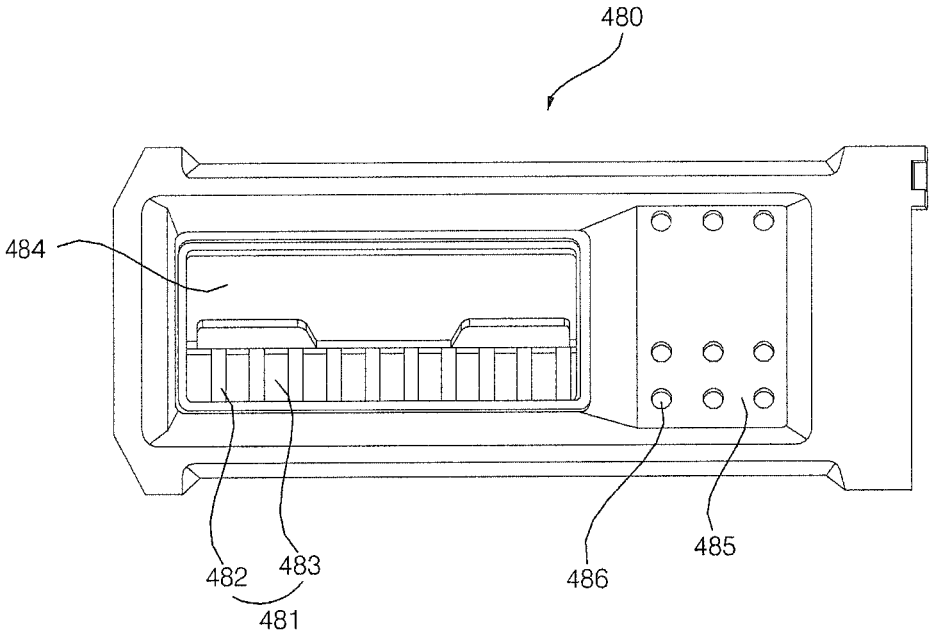
FIG. 18 is a front view illustrating still another embodiment of the auxiliary receiving platform applied to the washing machine of the present invention.

FIG. 18 is a front view illustrating another embodiment of the auxiliary receiving platform applied to the washing machine of the present invention. The same reference numerals same as those used in the first embodiment indicate the same members. In the following, a description will be given focusing on the differences between the previous embodiment and this embodiment.

Referring to FIG. 18, the additive seat portion 481 includes additive seats 481 for placing a solid additive thereon and a liquid additive 484 formed at one side of the additive seats 481. The additive seat portion 481 is formed in the same or similar manner as in the previous embodiment.

Now, the operation of the washing machine will be described. The user inserts the liquid additive through the liquid additive inlet 484. The liquid additive is stored in the additive storage unit 162 through the liquid additive inlet 484. When washing water enters from the outside, the washing water enters the liquid additive inlet 484. Moreover, the washing water flows to the additive storage unit 162 via the flow holes 483 formed in the additive seat portion 481. The liquid additive is mixed with the flowing washing water. The mixed washing water flows out through the outlet 190 in the same or similar manner as what has been previous described. The outflowing washing water enters the tub 21 and the drum 22.

Further, the liquid additive may flow to the additive flow portion 484 by the user's mistake. The liquid additive having flown to the additive flow portion 484 flows to the additive storage unit 162 in the same or similar manner as described above. Also, the washing water sprayed onto the liquid additive flows to the additive storage unit 162 via the additive flow holes 485 in the same or similar manner as described above. Accordingly, the user can easily solve the problem of adsorption of the liquid additive onto the auxiliary receiving platform 480.

When using a solid additive, the user places the solid additive on the additive seat portion 481. The solid additive may be formed in a sheet-shape. If the solid additive is sheet-shaped, the user folds the sheet-shaped additive to be suitable for the additive seat portion 481 and places it thereon. Once the user places the solid additive on the additive seat portion 481, washing water enters from the outside. The entering washing water dissolves the solid additive placed on the additive seat portion 481. The washing water with which the additive is dissolved is stored in the additive storage unit 162. The additive seat portion 481 is formed in the same or similar manner as what has been described in FIG. 4. That is, the additive seat portion 481 is recessed downward so as to be at a position lower than the outlet 190. The height of the outlet 190 is greater than the height from the additive storage unit 162 to the additive seat portion 481. Accordingly, the user is able to place and use the solid additive by means of the additive seat portion 481. In addition, if the solid additive is sheet-shaped, the user can use the solid additive with ease by means of the additive seat portion 481.

In addition, in the case of the solid additive, the washing water sprayed to the additive seat portion 481 by the washing water spraying device dissolves the solid additive. The solid additive-dissolved washing water is stored in the additive storage unit 162, and there may be a case where the solid additive-dissolved washing water overflows the additive storage unit. If the washing water overflows the additive storage unit 162, it flows to the additive flow portion 485 in the same or similar manner as described above. The flowing washing water flows to the additive storage unit 162 via the additive flow holes 486. Accordingly, the washing water is guided out of the detergent box 160 through the outlet 190 without overflowing the detergent box 160.

Although the washing machine according to the present invention has been described with reference to the illustrated drawings, it will be apparent to those skilled in the art that the present invention is not intended to be limited to the above-described embodiment and drawings, and various changes or modifications may be made therein without departing from the scope and the technical sprit of the present invention. That is to say, the present invention is not limited to a drum type washing machine, but can be applied to a water jet washing machine, etc.

What is claimed is:

1. A washing machine comprising:

an auxiliary receiving platform which is provided on a water-supply flow pathway for the supply of washing water, and which constitutes a container structure configured to support a solid non-powdered additive when such an additive is introduced;

an additive storage unit which supports the auxiliary receiving platform, and which is configured to store washing water to dissolve the solid non-powdered additive; and a siphon tube protruded upward from a bottom surface of the additive storage unit, the bottom surface being provided beneath the auxiliary receiving platform, wherein the auxiliary receiving platform includes:

at least one opening port formed at a bottom surface of the auxiliary receiving platform configured to directly introduce a liquid additive into the additive storage unit when the liquid additive is introduced; and a support plate formed at one side of the opening port configured to support the solid non-powdered additive when the solid non-powdered additive is introduced in order to ensure a sufficient amount of time for the solid non-powdered additive to be dissolved in the firstly supplied water, wherein an upper opening end of the siphon tube is higher than the bottom surface of the auxiliary receiving platform, the opening port, and the support plate, wherein the support plate has a plurality of holes which are smaller than the opening port, wherein the support plate is provided at the bottom surface of the auxiliary receiving platform, wherein an upper end of the opening port and an upper end of the support plate are provided on a same horizontal plane, and further includes:

water supply control valves that are mounted on the water-supply flow pathway, and are opened until the level of water in the additive storage unit reaches a first water level within a range higher than the inner bottom surface of the auxiliary receiving platform and lower than an upper opening end of the siphon tube, closed for a predetermined period of time during which the solid non-powdered additive can be dissolved in the supplied water, and then re-opened to supply the solid non-powdered additive-dissolved washing water into a washing tub through the siphon tube; and a controller to control the water supply control valves to be operated in a stepwise manner, wherein the auxiliary receiving platform has an overflow surface which is relatively shallower than the position of the support plate and the opening port, and a plurality of drainage holes are formed on the overflow surface to introduce the solid non-powdered additive into the additive storing unit, wherein the upper end of the opening port and the upper end of the support plate are positioned on the horizontal plane which is lower than an upper end of the plurality of drainage holes, wherein the plurality drainage holes are smaller than the opening port, wherein the siphon tube is provide below the overflow surface, and wherein the siphon tube is overlapped with at least one of the drainage holes in a vertical direction.

2. The washing machine of claim 1, wherein the support plate has a mesh-type structure to enable an upward and a downward flow of water.

3. The washing machine of claim 2, wherein an operation time for each step is entered and set into the controller to open, close, and re-open the water supply control valves at regular time intervals.

4. The washing machine of claim 3, wherein a water level sensor for detecting whether water reaches the first water level is further provided within a detergent box, and the controller detects a signal transmitted from the water level sensor and controls the water supply control valves to be opened, closed, and re-opened in a stepwise manner.

5. The washing machine of claim 4, wherein the overflow surface and the bottom surface of the auxiliary receiving platform are parallel.

6. A washing machine comprising:

an auxiliary receiving platform which is provided on a water-supply flow pathway for the supply of washing water, and which constitutes a container structure able to support a solid non-powdered additive when such an additive is introduced;

an additive storage unit which supports the auxiliary receiving platform, and which is able to store washing water to dissolve the solid non-powdered additive;

a siphon tube protruded upward from a bottom surface of the additive storage unit, the bottom surface being provided beneath the auxiliary receiving platform; and at least one opening port formed at a bottom surface of the auxiliary receiving platform configured to directly introduce a liquid additive into the additive storage unit when the liquid additive is introduced, wherein a support plate formed at one side of the opening port configured to support a solid additive when the solid additive is introduced in order to ensure a sufficient amount of time for the solid additive to be dissolved in the firstly supplied water, wherein an upper opening end of the siphon tube is higher than the bottom surface of the auxiliary receiving platform, the opening port, and the support plate, wherein the support plate has a plurality of holes which are smaller than the opening port, wherein the support plate is provided at the bottom surface of the auxiliary receiving platform, wherein an upper end of the opening port and an upper end of the support plate are provided on a same horizontal plane;

the auxiliary receiving platform further includes an additive flow portion adapted to allow the liquid additive to flow to the additive storage unit, the auxiliary receiving platform further includes an additive seat portion for placing the solid non-powdered additive thereon, and the additive seat portion is recessed downward to accommodate the solid non-powdered additive thereon, wherein an upper opening end of the siphon tube is higher than the additive flow portion and the additive seat portion, wherein the additive flow portion includes additive flow holes adapted to allow the liquid additive to flow to the additive storage unit, wherein the additive seat portion includes flow holes adapted to allow dissolved solid non-powdered additive to flow to the additive storage unit, wherein additive flow holes are smaller than the flow holes of the additive seat portion, wherein the additive flow holes are formed in plural form, and the plurality of additive flow holes are spaced apart at predetermined intervals, wherein the additive flow portion and additive seat portion are provided on a same plane, and further includes:

water supply control valve that are mounted on the water supply flow pathway, and are opened until the level of water in the additive storage unit reaches a first water level within a range higher than the inner bottom surface of the auxiliary receiving platform and lower than an upper opening end of the siphon tube, closed for a predetermined period of time during which the solid additive can be dissolved in the supplied water, and then re-opened to supply the solid additive-dissolved washing water into a washing tub through the siphon tube; and a controller to control the water supply control valves to be operated in a stepwise manner, wherein the upper end of the opening port and the upper end of the support plate are positioned on the horizontal plane which is lower than an upper end of the flow holes of the additive flow portion, wherein the flow holes of the additive seat portion are smaller than the opening port, wherein the siphon tube is provided below the additive flow portion, and wherein the siphon tube is overlapped with at least one of the flow holes of the additive flow portion in a vertical direction.

7. The washing machine of claim 6, wherein the additive flow portion includes a sloping surface sloped toward the additive flow holes.

8. The washing machine of claim 7, wherein the flow holes of the additive seat portion are formed in plural form so as to be spaced apart at predetermined intervals.

9. The washing machine of claim 8, wherein the additive seat portion includes a sloping surface sloped toward the flow holes of the additive seat portion.

10. The washing machine of claim 9, wherein the height of the additive seat portion is different from the height of the additive flow portion.

11. The washing machine of claim 10, wherein the height of the additive seat portion is less than the height of the additive flow portion.

12. The washing machine of claim 11, wherein the additive flow portion is adapted to allow washing water overflowing the additive seat portion to flow to the additive storage unit.

13. The washing machine of claim 11, wherein the solid non-powdered additive is a single piece having a prescribed shape.

* * * * *